US005997374A

United States Patent [19]

Pollack

[11] Patent Number: 5,997,374

[45] Date of Patent: Dec. 7, 1999

[54] VESSEL SECURING SYSTEM

[75] Inventor: Jack Pollack, Calabasas Hills, Calif.

[73] Assignee: Imodco, Inc., Calabasas, Calif.

[21] Appl. No.: 09/072,546

[22] Filed: May 5, 1998

[51] Int. Cl.[6] ..... B63B 22/02

[52] U.S. Cl. ..... 441/3; 114/230.21

[58] Field of Search ..... 114/230.2, 230.21, 114/230.22, 230.23, 230.24, 144 B, 293, 247; 441/3

[56] References Cited

U.S. PATENT DOCUMENTS

| | | | |
|---|---|---|---|
| 4,070,981 | 1/1978 | Guinn et al. | 114/293 |
| 4,200,052 | 4/1980 | Cunningham et al. | 114/230 |
| 5,178,087 | 1/1993 | O'nion | 114/230 |

FOREIGN PATENT DOCUMENTS

| | | | |
|---|---|---|---|
| 9000363 | 9/1991 | Netherlands | 441/3 |
| 1017327 | 1/1966 | United Kingdom | 441/3 |

*Primary Examiner*—Sherman Basinger
*Attorney, Agent, or Firm*—Rosen Hornbaker Freilich

[57] ABSTRACT

A system is provided for securing a vessel (24) such as a tanker to a moored body (12) that is moored to the sea floor, which enables the vessel to remain secured in more severe weather. In addition to the deployed length (27) of securing line (26) that extends between the moored body and the vessel, applicant stores an additional length (28) of securing line. When large drift forces are applied to the vessel, the vessel is allowed to drift away from the moored body, while a braking apparatus (34) pays out the previously-stored length of securing line, while resisting such pay out by maintaining a high securing line tension such as 300 tons. When the drift force decreases to a predetermined low level such as 60 tons, the braking apparatus draws in the securing line to draw back the vessel towards its quiescent position. By allowing vessel drift while absorbing energy from the securing line being paid out, applicant significantly slows the drifting vessel so the vessel does not drift as far and has less velocity when the drift forces have decreased.

8 Claims, 2 Drawing Sheets

VESSEL SECURING SYSTEM

BACKGROUND OF THE INVENTION

This relates to the securing of a vessel such as a tanker, to a moored body such as a buoy or another vessel that is moored to the sea floor.

Tankers are often temporarily secured to moored bodies that lie at the sea surface and that are moored to the sea floor. The moored body is often a buoy or vessel that floats at the sea surface and that is moored by catemary chains to the sea floor. However, some moored bodies lying at the sea surface are moored by a single anchor leg or form the top of a fixed tower. Tankers are often moored to such bodies by elastic mooring lines which have one line end fixed to the vessel bow (sometimes the stem) and an opposite end fixed to the moored body. The elastic line is designed to elongate under an increasing load so the tanker can remain moored in difficult weather without exceeding line tension capacity. In a severe sea state, the capacity of the elastic line can be exceeded and the tanker must cast off when severe weather is approaching. A system for securing a vessel to the moored body, which enables the vessel to remain moored in more severe weather, would be of value.

SUMMARY OF THE INVENTION

In accordance with one embodiment of the present invention, a system is provided for securing a vessel to a moored body that is anchored to the sea floor, which allows the vessel to remain secured in severe weather. A largely horizontal securing line extends between the body and the vessel, with an additional length of securing line being stored at either the moored body or the vessel, and preferably at the moored body. An apparatus is coupled to the securing line to pay out securing line when it is under high tension, to allow the vessel to drift away from the moored body but to absorb energy by maintaining a high tension as the securing line is paid out. The absorption of energy by maintaining a high tension during securing line pay out, results in slowing the vessel so it will not have drifted as far when the drift forces have decreased. The apparatus for paying out securing line, is also constructed to draw back the line when the line tension has decreased below a predetermined level, to pull back the vessel towards its quiescent position so it is ready to withstand another large drift force.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
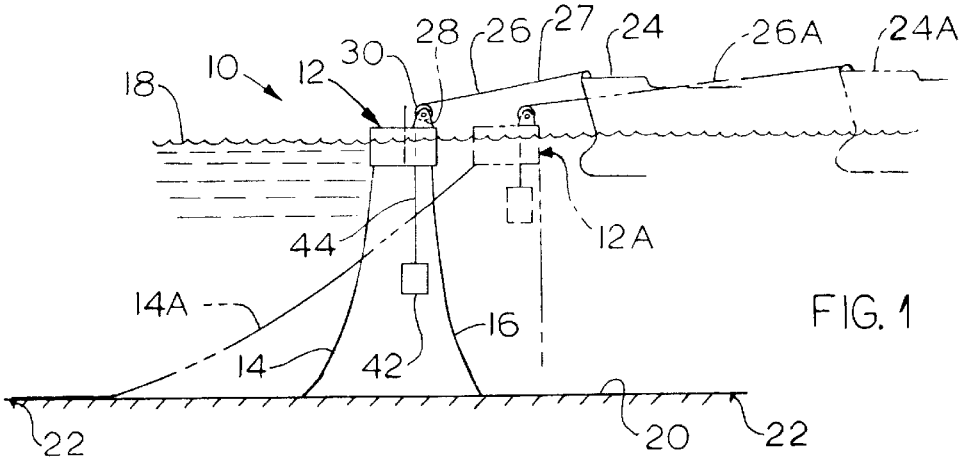
FIG. 1 is a side elevation view of a vessel securing system constructed in accordance with the present invention, showing a moored body and a vessel in a quiescent position, and also showing them, in phantom lines, in a drifted position.

FIG. 1 illustrates a system 10 of the CALM (catenary anchor leg type) which includes a buoyant body 12 floating at the sea surface 18. The body is anchored to the sea floor by several chains such as 14, 16 that extend in different headings and in catenary curves to the sea floor 20, and along the sea floor to anchors 22. This system is constructed so the moored body 12 remains permanently at the site. Occasionally, a vessel 24 comes to the location of the body 12 and is secured to the body by a securing line 26 with a deployed length 27 that extends between the moored body 12 and the secured vessel 24. In severe weather, large forces are applied by currents, winds, and waves to both the moored body 12 and secured vessel or other second body 24, tending to cause them to drift, as to the positions 12A and 24A. In many cases, the secured vessel 24 has a much larger cross section than that of the moored body 12, so large forces must be withstood by the securing line 26.

If a securing line 26 is an elastic line, then it stores energy as the vessel drifts, by progressively increasing in length as tension increases, with the elongation being used to pull the vessel back after the drift forces on the vessel decrease. However, the elongation of the elastic line is limited, so it cannot allow large drift and cannot withstand large and long period drift forces applied to the vessel. It is noted that oscillating wave drift loads can be the largest loads on large vessels, which are vessels having a displacement of more than ten tons and usually more than fifty tons. Such large vessels, when moored to the buoy, have natural frequencies of oscillation in drift away and toward a quiescent position, on the order of magnitude of 100 seconds, which is a frequency that can be excited by wave drift forces. Such wave drift forces may be applied during periods on the order of 100 seconds with greatly decreased force between such applications.

In accordance with the present invention, applicant stores a length 28 of the securing line 26, as on a winch apparatus 30 on the body 12 (or on the vessel 24), so the securing line 26 can be payed out when large drift forces are applied to a vessel, and the line can be drawn back when the drift forces decrease. In addition, the winch apparatus 30 is braked as the securing line 26 is pulled from the winch by a drifting vessel, to absorb energy and damp the drifting vessel, so the vessel drifts slower and not as far for a given drift force profile.

Figure 2:
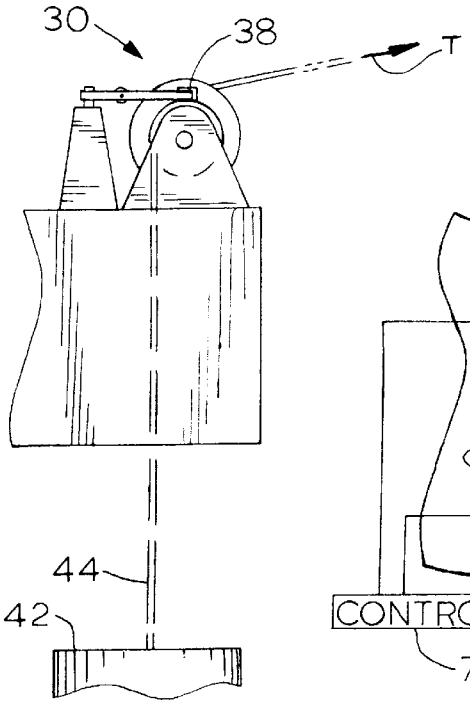
FIG. 2 is a side elevation view of a portion of the system of FIG. 1.
Figure 3:
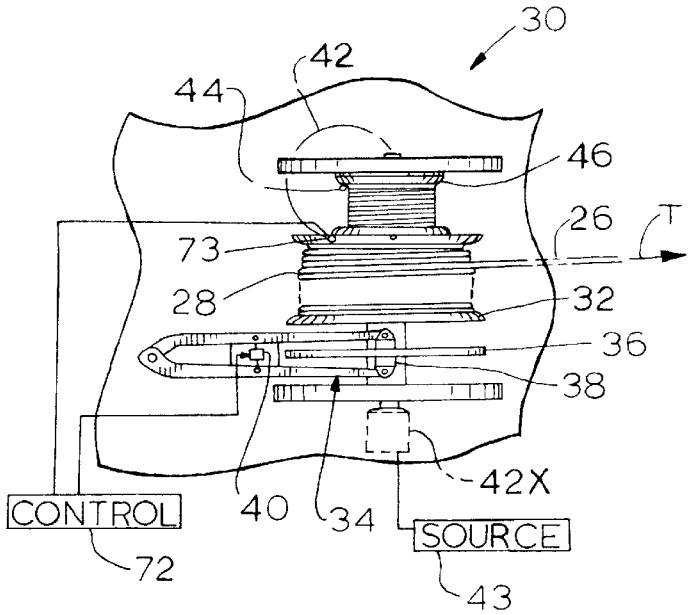
FIG. 3 is a plan view of the portion of the system of FIG. 2.

FIGS. 2 and 3 show some details of the winch apparatus 30. The winch apparatus includes a pulley or wind-up drum 32 from which the securing line 26 can be payed out and wound up. A brake apparatus, or mechanism 34 which includes a brake disk 36 and brake shoes 38 that are moved against the disk by a hydraulic actuator 40, resists pay out of the securing line 26. A weight 42 connected by a weight line 44 to a reel 46, continually applies torque to the wind-up drum 32 to draw in the securing line. The application of torque by weight 42 and reel 46 can also be supplied by a motor device which could be energized, for example, by stored energy that was generated during pullout of the securing line 26. The weight line 44 could be the stored part of the securing line.

The brake mechanism 34 is preferably applied at all times, except when tension on the securing line 26 has dropped to a moderate level and the vessel is more than a predetermined distance from the moored body 12 (so the weight is above its lowest position). Accordingly, in moderate seas when the securing line tension T is moderate, the winch apparatus 30 does not pay out line. Only when the line tension T exceeds a predetermined level (e.g. 300 tons), and the brake disk 36 begins to turn despite friction by the brake shoes, is line payed out. Although the line is payed out, drift of the vessel is slowed by the high tension in the line resulting principally from the friction of the brake mechanism.

Figure 4:
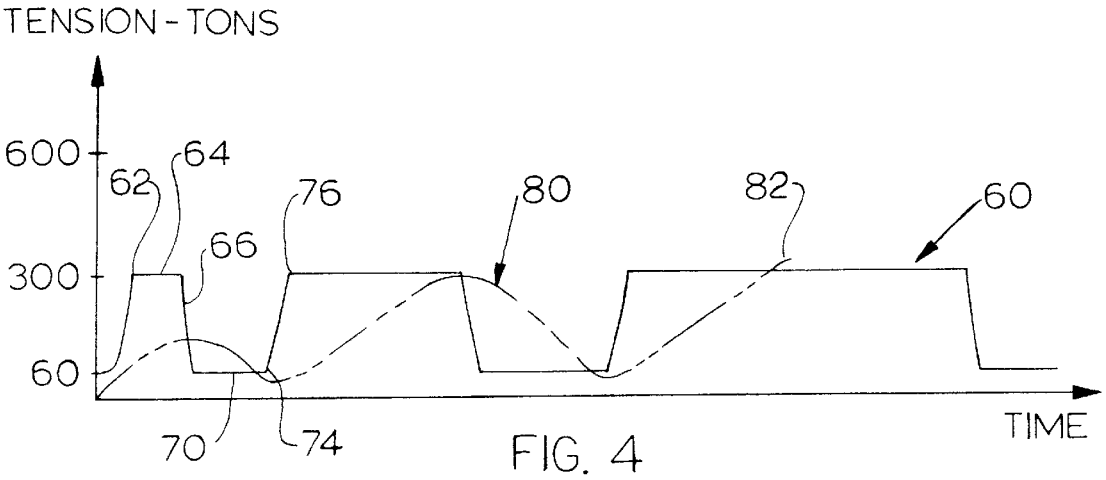
FIG. 4 includes a graph showing variation in securing line tension with time for the vessel of FIG. 1 during three periods of drift away from a quiescent position and during pull back and maintenance at the quiescent position, and also including, in phantom lines, a graph showing variation in elastic line tension with time under the same vessel drift forces in a prior art system that uses an elastic securing line.

FIG. 4 includes a graph 60 showing variation in tension for the deployed length of a securing line 26, for the system of FIGS. 1–3, for a vessel of 25,000 tons displacement. When there is only a moderate drift force on the vessel, which is less than 300 tons, the vessel does not drift substantially. This is because the brake mechanism (which applies 240 tons resistance) is applied in addition to the weight 42 (of 60 tons). When the drift force exceeds 300 tons, at graph point 62, the securing line is payed out along the graph line segment 64, so tension in the chain does not exceed 300 tons. The vessel moves at a speed dependent on wave drift force and other drift forces, but the drift speed may be only 0.3 knots because of the 300 tons of chain tension that slows the drifting vessel, instead of 1.3 knots. Graph line segment 66 shows the drift force on the vessel decreasing from about 300 tons to less than 60 tons.

When the tension in the securing line drops below a certain level such as 60 tons the brake is released and the securing line is drawn in as indicated at graph line segment 70. That is, a control 72 (FIG. 3) connected to a sensor 73, senses when the line tension has fallen below 60 tons (at a time when the length of the securing line exceeds the quiescent condition length) and operates the actuator 40 to release the brake shoes from the brake disk, so the line can be drawn in as the weight 42 moves down. At point 74 in the graph of FIG. 4, the line tension has again exceeded 60 tons and the brake mechanism is then applied to again prevent line pay out until the line tension exceeds 300 tons, which happens at point 76. Thus, the securing line is repeatedly payed out and drawn in as the drift force increases to a high level and then drops to a low level. By applying a large tension such as 300 tons during vessel drift, the speed of the drifting vessel is decreased; with the vessel moving slower and therefore having less vessel momentum, the vessel does not drift as far. The draw-in force, such as 60 tons, is preferably no more than half the pay out force such as 300 tons. While considerable energy is absorbed during payout (by the brake) to slow payout and vessel drift, substantially no energy (preferably less than 10%) is absorbed from the falling weight during draw-in in order to obtain rapid draw-in (except as the weight approaches its lowest position).

FIG. 4 also includes a graph line 80 indicating variation in chain tension with time for a prior art elastic mooring line that was stretched but was not payed out or drawn in. It can be seen that the mooring force starts to reach higher levels at 82, largely due to the higher vessel speed. The higher vessel speed for an elastic line is due to the fact that securing line tension does not reach a high level until the vessel has drifted considerably and gained speed and momentum. When weather conditions indicate that point 82 is likely to be reached, the vessel was cast off and sailed away in the prior art system. Applicant notes that a securing line 26 (FIG. 1) of a low cost but high strength material such as steel, can carry a much higher tension than an elastic line of the same diameter or cost or even weight.

The tension during pay out, which is a plurality of tons, such as 300 tons, is preferably more than twice as great as the tension, such as 60 tons, applied during draw in of the line. This is because a moderate draw in force such as 60 tons is usually sufficient to pull back the vessel between large drift forces. Also, this results in the drawing-in mechanism such as the weight 42 or a braking mechanism in the form of an electric or hydraulic motor 42*x*, being of only moderate size and weight. The draw-in force is preferably at least 10% of the tension during pay out, to move back the vessel significantly between large drift forces. A strong and moderate cost securing line 26 is usually sufficiently non-elastic that it stretches less that 10% before the line is payed out.

The electric or hydraulic motor could be a motor/generator used as a braking mechanism that resists payout of the securing line, with the energy generated being stored to later draw in the line, and/or with the energy being dissipated as heat, and/or with the energy being used to generate electricity or pressured fluid for useful purposes (instead of to generate heat). In FIG. 3, a source 43 such as a tank that stores pressured fluid pumped in by a hydraulic motor at 42X, or an electric battery that stores electricity delivered to it by an electric motor/generator at 42X, provides energy to turn the motor 42X to draw in the securing line.

FIG. 7 includes a graph 90 that shows tension in tons vs. drift of the vessel from a quiescent condition (still waters) wherein the length of the securing line is usually (in clam seas) a minimum (e.g. 20 meters). The drift of the vessel is given as a percent of initial securing line length (in the quiescent condition). Between 0 and 5% drift, the securing line is pulled even straighter and is stretched. At 5% drift (point 92), the securing line tension has reached 300 tons and the line begins to be payed out. At 100% drift (point 94) the drift force is assumed, in this example, to begin decreasing and decreases to under 60 tons. The brake is released, and the weight draws back the securing line and the vessel to near zero drift (zero drift away from the quiescent position). The area within the graph 90 represents energy absorbed from the drifting vessel by the brake mechanism (usually dissipated as heat).

Figure 6:
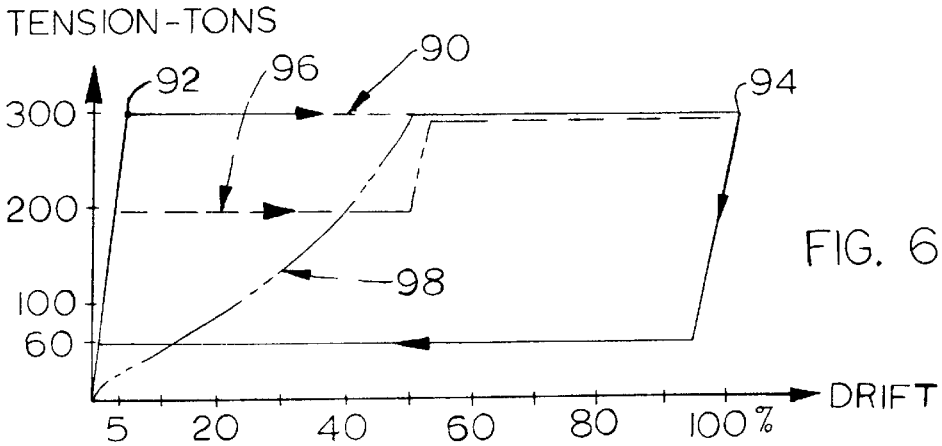
FIG. 6 is a graph showing variation in securing line tension with drift of a vessel, wherein drift is stated as a percent of initial securing line length, for the system of FIG. 1, and showing in phantom lines the characteristics for another embodiment of the system of FIG. 1, and also showing in phantom lines a variation in securing line tension with drift as a percent of securing line initial length for a prior art elastic securing line.

FIG. 6 also includes a graph 96 that is similar to graph 90, except that in graph 96 the securing line is initially payed out when a lower securing line tension such as 200 tons is sensed. Only if the drift reaches a high level such as 50% of initial securing line length, is the line payed out only when the tension reaches or exceeds 300 tons. This system has the advantage that less stress is applied to the system parts (e.g. brake mechanism parts) in moderate to moderatelysevere seas, and yet vessel drift is greatly reduced in severe seas. FIG. 6 includes a graph 98 that indicates the tension-drift characteristics of a prior art elastic line that can elongate up to 50%. The area under the graph 96 is about half the area under graph 90 between 0 and 50% of drift, showing that the vessel is not slowed as much.

Figure 5:
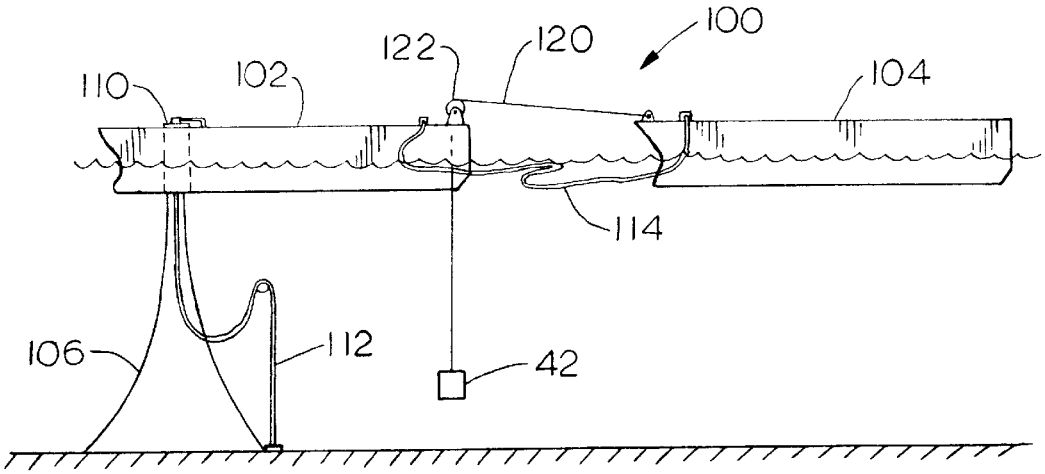
FIG. 5 is a side elevation view of a vessel securing system constructed in accordance with another embodiment of the invention.

FIG. 5 illustrates a system 100 wherein two vessels 102, 104 are tied together by applicant's vessel securing system. The first vessel 102 is moored to the sea floor through catenary chains 106 extending from a turret 110 that can rotate about a vertical axis on the vessel hull. The vessel has hydrocarbon processing equipment and is connected through conduits 112 to sea floor wells. This type of vessel 102 enables production of hydrocarbons and storage of such hydrocarbons, with a tanker such as 104 offloading the stored hydrocarbons through conduits 114 during periods of perhaps three days each. This same type of mooring system can be used as in FIGS. 1–3. In FIG. 5 a securing line 120 extends from a winch apparatus 122 on the moored vessel 102 to the secured vessel 104. The winch apparatus 122 is of a type shown in FIGS. 1–3. Although the vessel 102 drifts and is limited in drifting by the mooring lines 106, the secured vessel 104 is separately subjected to drift forces which are carried by the securing line 120.

Although the winch apparatus 30 or 122 is shown mounted on the moored body 12 or 102 that is directly moored to the sea floor, the winch apparatus can be mounted on the secured vessel 24 or 104. It is even possible to mount a winch apparatus on both the moored body and the secured vessel. Applicant prefers to provide a winch apparatus only on the moored body, because the winch apparatus is used more frequently with the moored body than with any one second vessel.

Thus, the invention provides a system for securing a vessel to a moored body that is anchored to the sea floor, which enables the vessel to remain secured in severe weather wherein very high drift forces are encountered. The system includes a securing line with a deployed portion extending between the moored body and the vessel, and with a stored portion lying at one of them and preferably at the moored body. An apparatus such as at the moored body, is constructed to pay out the stored length of securing line when high drift forces are encountered by the secured vessel, but to absorb energy during line payout by maintaining a high tension in the securing line as it is paid out. The high tension reduces the speed of the vessel as it drifts, so the vessel does not drift as far or have such a high momentum when the drift forces decrease to a low level. The apparatus for paying out line is constructed to also draw in the line when the line tension has decreased to a predetermined level to pull back the vessel towards its quiescent position. Although the vessel can drift by a small amount before line has to be paid out, a high line tension is maintained along any drift distance that is more than about 20 percent of the initial distance between the body and vessel and of the initial length of securing line.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A system which includes a first body that floats at the sea surface and that is anchored to the sea floor and that can drift but with the drift resisted by its mooring to the sea floor, for securing a second body that floats at the sea surface and that has bow and stern ends, comprising:

a single securing line extending primarily horizontally from said first body to the bow of said second body, to limit drift of said second body away from said first body while allowing said second body to weathervane and rotate to different positions about said first body;

a rotatable member on one of said bodies, with said securing line extending about said rotatable member;

braking apparatus coupled to said rotatable member and operable to resist rotation of said rotatable member;

a control coupled to said braking apparatus and constructed to operate said braking apparatus to allow payout of said securing line only when a predetermined tension in said securing line is reached.

2. The system described in claim 1 wherein:

means coupled to said rotatable member for turning said rotatable member in a direction to draw in and thereby reduce the length of said securing line, to thereby pull back said second body toward said first body;

said control is constructed to control said means for turning to apply a tension to draw in said securing line, where said tension to draw in is less than half said predetermined tension during securing line payout.

3. The system described in claim 1 wherein:

said braking apparatus includes a weight that is movable up and down and a weight line extending up from said weight and coupled to said rotatable member to apply torque to said member that urges it to rotate in a direction to draw in said securing line.

4. The system described in claim 1 wherein:

said rotatable member comprises a rotatable brake member and said braking apparatus includes a brake shoe for pressing against said brake member to convert energy into heat;

said braking apparatus includes a motor that is connected to said rotatable member, and a source of energy coupled to said motor to energize it to draw in said securing line.

5. An offshore system for use in a sea having a sea surface and a sea floor, for mooring a vessel that has a bow and a stern, comprising:

a buoyant body that floats at the sea surface;

means for anchoring said buoyant body to the sea floor;

a securing line for extending between said buoyant body and the bow of said vessel;

apparatus coupled to said securing line for paying out and drawing in said securing line, including means for absorbing energy from said line when said line is being payed out while it is under high tension;

said means for absorbing energy being constructed, so when the vessel drifts a predetermined additional distance from an initial distance from said buoyant body, said tensioned line is payed out and said means for absorbing energy absorbs energy along a majority of said additional distance of drift.

6. The system described in claim 5 wherein:

said apparatus is constructed so it applies a predetermined high tension during line payout, and applies a tension during line draw in that is always no more than half of said predetermined high tension.

7. A method for securing a second buoyant body to a first body that floats at the sea surface and that is anchored to the sea floor by anchor lines that extend from said first body to the sea floor, comprising:

establishing a length of a primarily horizontal securing line in extension between said first and second bodies and storing some of said securing line so it can be payed out from one of said bodies;

when forces tend to cause drift of said bodies, allowing both of said bodies to drift, while resisting drift of first body through said anchor lines that extend to the sea floor, and while allowing but resisting drift of said second body relative to said first body, by paying out additional length of said securing line when the tension in said securing line exceeds a predetermined level while absorbing energy from line payout during such payout of additional length of said securing line.

8. The method described in claim 7 wherein:

said securing line has an initial length which is maintained in a quiescent position in a quiet sea;

when said vessel drifts from said quiescent position by a distance of more than 20% of said initial length of said securing line, then said step of absorbing includes absorbing energy during the payout of a majority of the length of line that is payed out.

* * * * *